US010698341B2

(12) United States Patent
Koga

(10) Patent No.: US 10,698,341 B2
(45) Date of Patent: Jun. 30, 2020

(54) DEVELOPING DEVICE

(71) Applicant: CANON KABUSHIKI KAISHA, Tokyo (JP)

(72) Inventor: Shunichi Koga, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/385,102

(22) Filed: Apr. 16, 2019

(65) Prior Publication Data

US 2019/0317424 A1 Oct. 17, 2019

(30) Foreign Application Priority Data

Apr. 17, 2018 (JP) ..... 2018-079406

(51) Int. Cl.
*G03G 15/08* (2006.01)
*G03G 15/00* (2006.01)

(52) U.S. Cl.
CPC ..... *G03G 15/0813* (2013.01); *G03G 15/0808* (2013.01); *G03G 15/0822* (2013.01); *G03G 15/0877* (2013.01); *G03G 15/0893* (2013.01); *G03G 15/5054* (2013.01)

(58) Field of Classification Search
CPC ..... G03G 15/0813; G03G 15/0808; G03G 15/0822; G03G 15/0865; G03G 15/0877; G03G 15/0879; G03G 15/0887; G03G 15/0889; G03G 15/0891; G03G 15/0893; G03G 15/5054
See application file for complete search history.

(56) References Cited

U.S. PATENT DOCUMENTS

| | | | | |
|---|---|---|---|---|
| 5,710,961 | A | 1/1998 | Jeong | |
| 9,996,025 | B1 * | 6/2018 | Amano | G03G 15/0865 |
| 2009/0103954 | A1 * | 4/2009 | Nakayama | G03G 15/0808 399/260 |
| 2011/0229208 | A1 * | 9/2011 | Watanabe | G03G 15/0822 399/254 |

FOREIGN PATENT DOCUMENTS

| | | | |
|---|---|---|---|
| JP | H04-291282 | A | 10/1992 |
| JP | 2003-091157 | A | 3/2003 |
| JP | 2009-237141 | A | 10/2009 |
| JP | 2011-102950 | A | 5/2011 |
| JP | 2013-057829 | A | 3/2013 |
| JP | 2014-186147 | A | 10/2014 |
| JP | 2017-044808 | A | 3/2017 |

OTHER PUBLICATIONS

Japanese Office Action dated Sep. 17, 2019, in related Japanese Patent Application No. 2018-079406.

* cited by examiner

*Primary Examiner* — Carla J Therrien
(74) *Attorney, Agent, or Firm* — Venable LLP

(57) ABSTRACT

A developing device includes an accommodating member, a developer carrying member, a feeding screw provided with a helical blade, a bearing portion, and a guiding portion including an inclined surface. With respect to the developer feeding direction, a position of an edge of a receiving port of the accommodating member on a bearing portion side is closer to the bearing portion than a most-upstream end of the blade with respect to the developer feeding direction. With respect to the developer feeding direction, a position of a downstream end portion of the inclined surface is remoter from the bearing portion than the most-upstream end of the blade with respect to the developer feeding direction.

17 Claims, 6 Drawing Sheets

(a)

(b)

(c)

DEVELOPING DEVICE

FIELD OF THE INVENTION AND RELATED ART

The present invention relates to a developing device for use with an image forming apparatus, such as a printer, a copying machine, a facsimile machine or a multi-function machine, using electrophotography.

The image forming apparatus includes the developing device for developing an electrostatic latent image, formed on a photosensitive drum, into a toner image with a developer. Further, the image forming apparatus includes a supplying device for supplying a developer for supply to the developing device and includes a cleaning device for removing the developer remaining on the photosensitive drum or the like. In the image forming apparatus in an accommodating member capable of accommodating the developer, the developer received through a receiving port is fed by a feeding screw. The feeding screw is rotatably supported by a bearing portion in the accommodating member.

Incidentally, when the developer enters the bearing portion, toner contained in the developer is melted by heat (frictional heat) generated by friction between the feeding screw and the bearing portion and then is cooled, so that the toner can agglomerate. Further, for example, in the case of the developing device, the agglomerated toner causes image defects such that the agglomerated toner adheres to the bearing portion and thus the feeding screw is not readily rotated at a desired process speed and that the agglomerated toner has an influence on the electrostatic latent image during development and thus stripe density non-uniformity generates on an image. Therefore, in order to prevent entrance of the developer into the bearing portion, a ring seal made of a resin material is provided at the bearing portion.

However, in the case where the receiving port is formed in proximity to the bearing portion and the developer is received through the receiving port in a large amount at once, feeding of the developer by the feeding screw cannot catch up with the received toner in the large amount, so that the developer is liable to enter the bearing portion. Therefore, conventionally, on the basis of an angle of repose and a collapse angle of the developer received through the receiving port, the receiving port and the bearing portion are disposed so as to be spaced from each other and thus a developing device in which toner agglomeration does not readily occur has been proposed (Japanese Laid-Open Patent Application (JP-A) 2011-102950).

However, in the developing device disposed in JP-A 2011-102950, the receiving port and the bearing portion are disposed at positions spaced from each other, so that a depth of an image forming apparatus including the developing device is upsized.

SUMMARY OF THE INVENTION

A principal object of the present invention is to provide a developing device in which a supplied developer is not readily moved toward a bearing portion.

According to an aspect of the present invention, there is provided a developing device comprising: an accommodating member provided with a receiving port through which a developer is received and capable of accommodating the developer; a developer carrying member supported by the accommodating member and configured to carry and feed the developer; a feeding screw capable of feeding the developer supplied through the receiving port, wherein the feeding screw is provided below the receiving port in a vertical direction and is provided with a rotation shaft and a helical blade formed around the rotation shaft; a bearing portion configured to support the feeding screw on a side upstream of the feeding screw with respect to a developer feeding direction; and a guiding portion including an inclined surface which is inclined downward in the vertical direction from an upstream side toward a downstream side thereof with respect to the developer feeding direction and which is configured to guide, toward the feeding screw, the developer received through the receiving port, wherein with respect to the developer feeding direction, a position of an edge of the receiving port on a bearing portion side is closer to the bearing portion than a mostupstream end of the blade with respect to the developer feeding direction, and wherein with respect to the developer feeding direction, a position of a downstream end portion of the inclined surface is remoter from the bearing portion than the mostupstream end of the blade with respect to the developer feeding direction.

Further features of the present invention will become apparent from the following description of exemplary embodiments with reference to the attached drawings.

Figure 6:
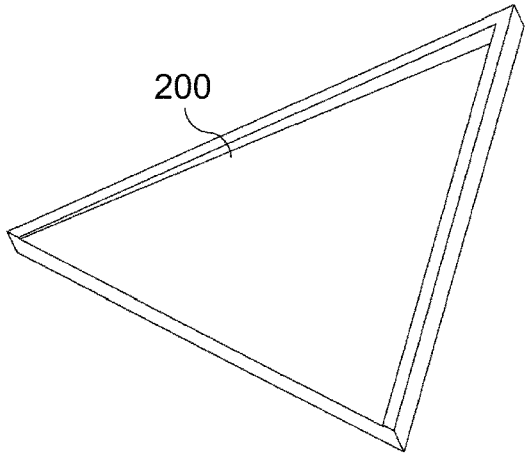
Figure 6:
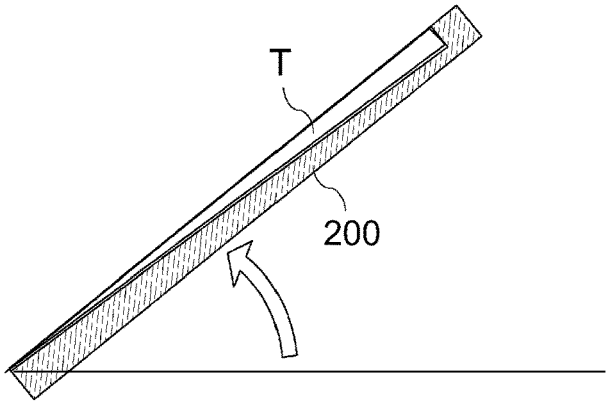
Figure 6:
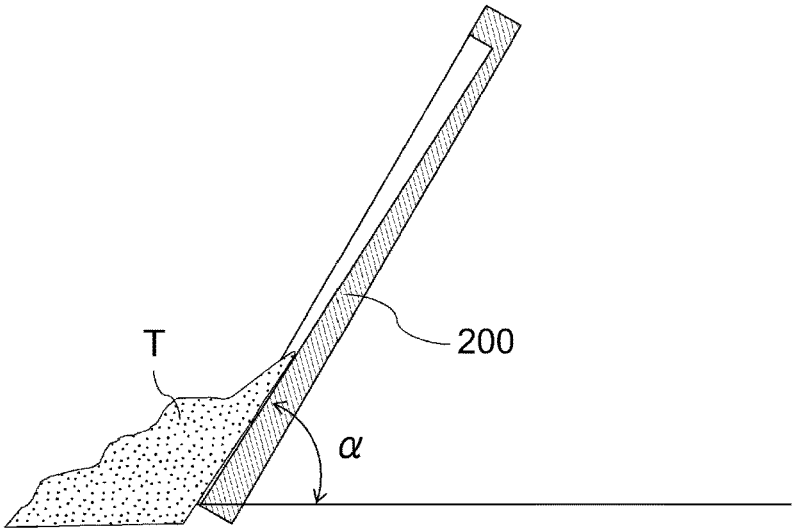

Parts (a), (b) and (c) of FIG. 6 are schematic views for illustrating a measuring method of an angle of repose of a developer, in which part (a) of FIG. 6 is a perspective view showing a measuring device of the angle of repose, part (b) of FIG. 6 is a side view showing the measuring device of the angle of repose, and part (c) of FIG. 6 is a side view showing the angle of repose.

Figure 7:
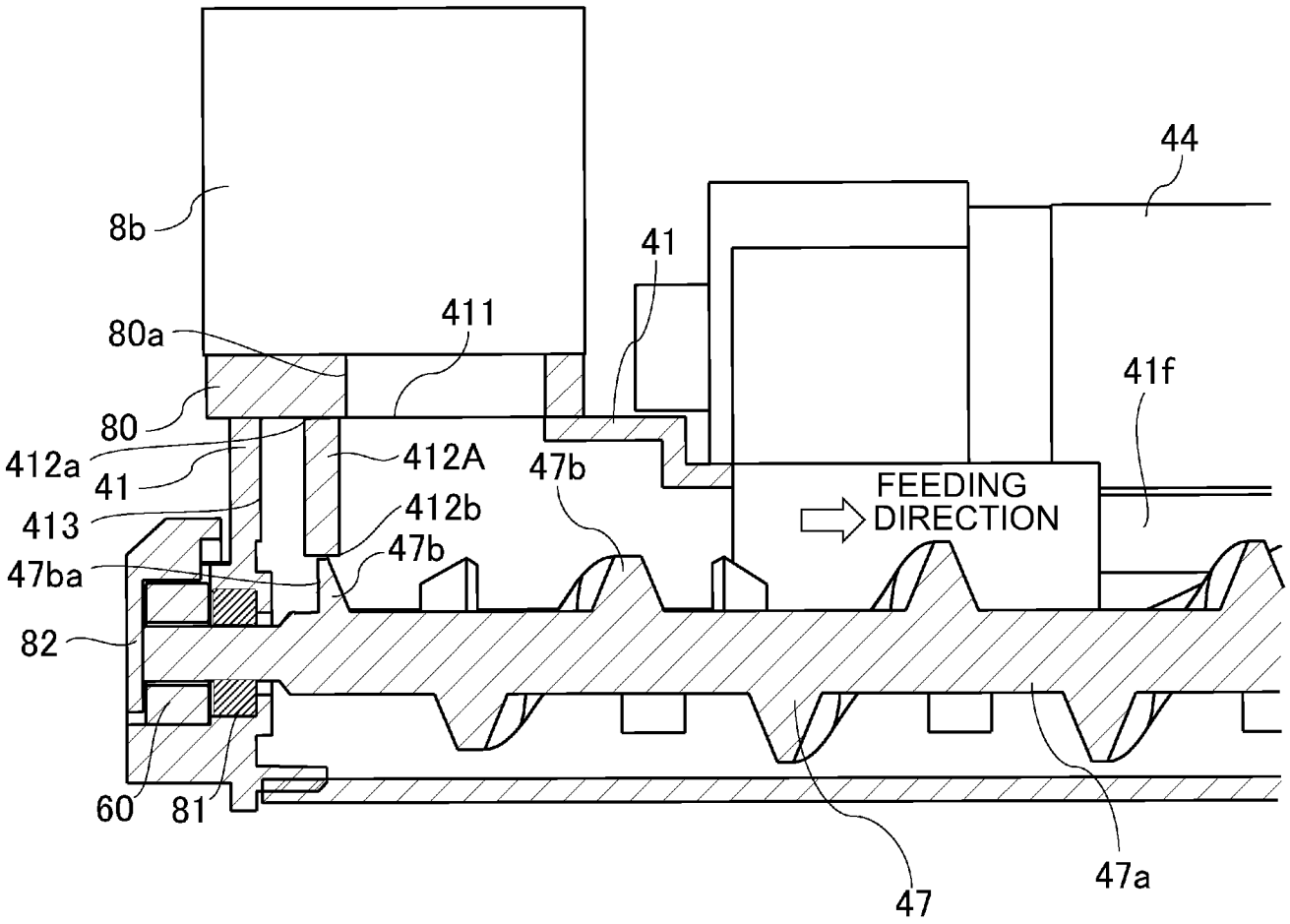

FIG. 7 is an enlarged sectional view showing a neighborhood of a bearing portion in a developing device in another embodiment.

DESCRIPTION OF EMBODIMENTS

[Image Forming Apparatus]

Figure 1:
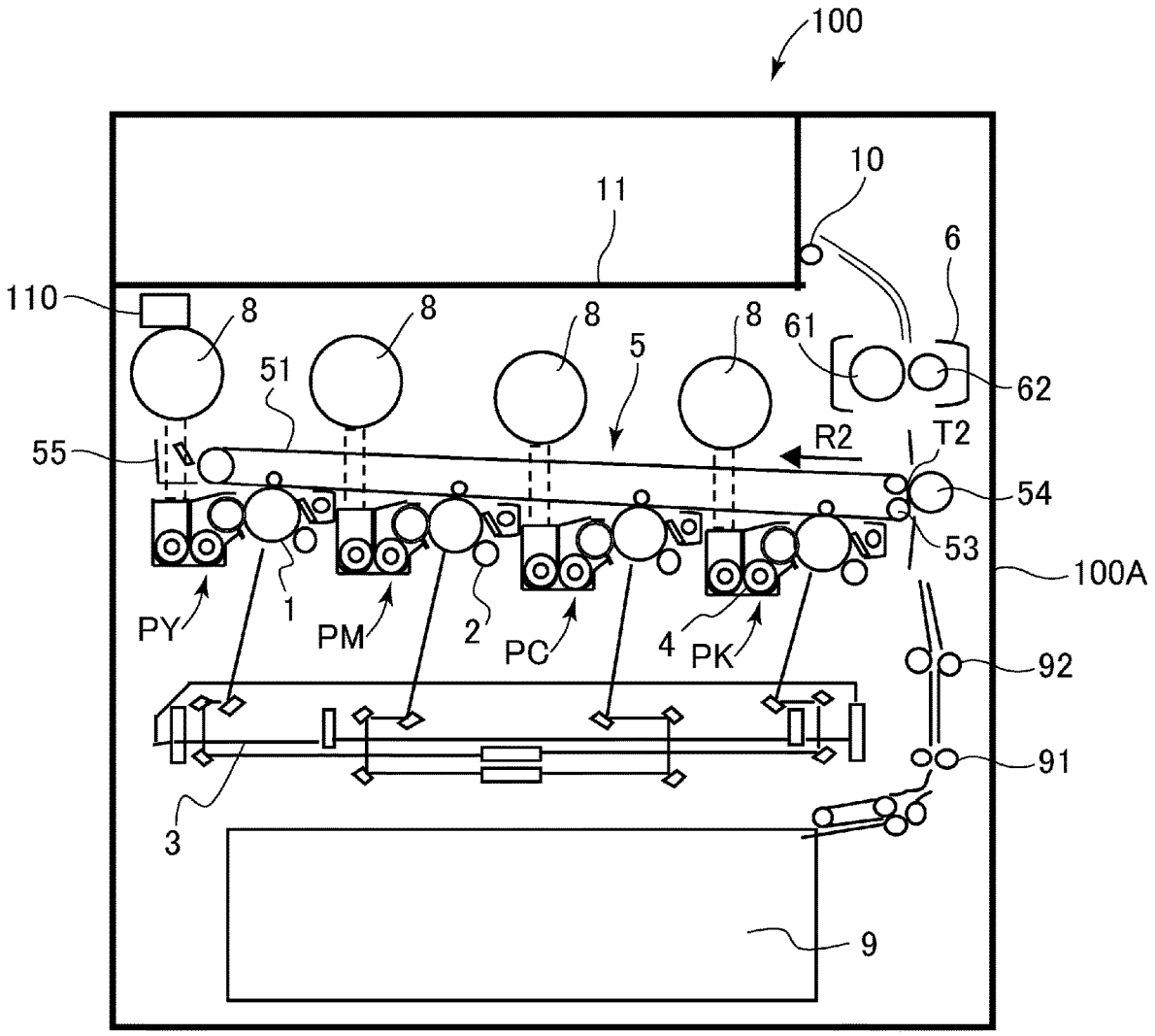
FIG. 1 is a schematic view showing a structure of an image forming apparatus for which a developer accommodating device in an embodiment is used suitably.

A general structure of an image forming apparatus for which a developer accommodating device in this embodiment is used suitably will be described using FIGS. 1 and 2. An image forming apparatus 100 in this embodiment is a full-color tandem image forming apparatus of an electrophotographic type. The image forming apparatus 100 is capable of forming a full-color image on a recording material in accordance with an image signal sent from an original reading device connected with an apparatus main assembly 100A thereof, an external device such as a personal computer or the like connected communicatably with the apparatus main assembly 100A, or the like device although these devices are omitted from illustration in the figures. As the recording material, it is possible to use a sheet material such as a sheet, a plastic film or a cloth.

The image forming apparatus 100 includes image forming portions PY, PM, PC and PK for forming images of yellow, magenta, cyan and black, respectively. On these image forming portions PY, PM, PC and PK, an intermediary transfer device 5 is provided. The intermediary transfer device 5 includes an intermediary transfer belt 51 which is stretched by a plurality of rollers and which is constituted so as to be moved in an arrow R2 direction. The intermediary transfer belt 51 is capable of carrying and moving a toner image primary-transferred from a photosensitive drum 1 in a manner described later. At a position opposing a secondary transfer inner roller 53 for stretching the intermediary transfer belt 51, a secondary transfer outer roller 54 is provided while sandwiching the intermediary transfer belt 51 between the rollers 53 and 54. These rollers 53 and 54 form a secondary transfer portion T2 where the toner image is secondary-transferred from the intermediary transfer belt 51 onto a recording material.

Below the image forming apparatus 100, a cassette 9 in which recording materials are accommodated is provided. The recording material fed from the cassette 9 is fed toward a registration roller pair 92 by a feeding roller pair 91. A leading end of the recording material abuts against the registration roller pair 92 in a rest state and then forms a loop, so that oblique movement of the recording material is corrected. Thereafter, the registration roller pair 92 rotates in synchronism with the toner image on the intermediary transfer belt 51, so that the recording material is fed to the secondary transfer portion T2.

A process for forming the full-color image by the above-described image forming apparatus 100 will be described. The four image forming portions PY to PK of the image forming apparatus 100 have substantially the same constitution except that colors of the respective developers are different from each other. Therefore, in the following, the image forming portion PK for black will be described as a representative example, and other image forming portions PY, PM and PC will be omitted from description.

Figure 2:
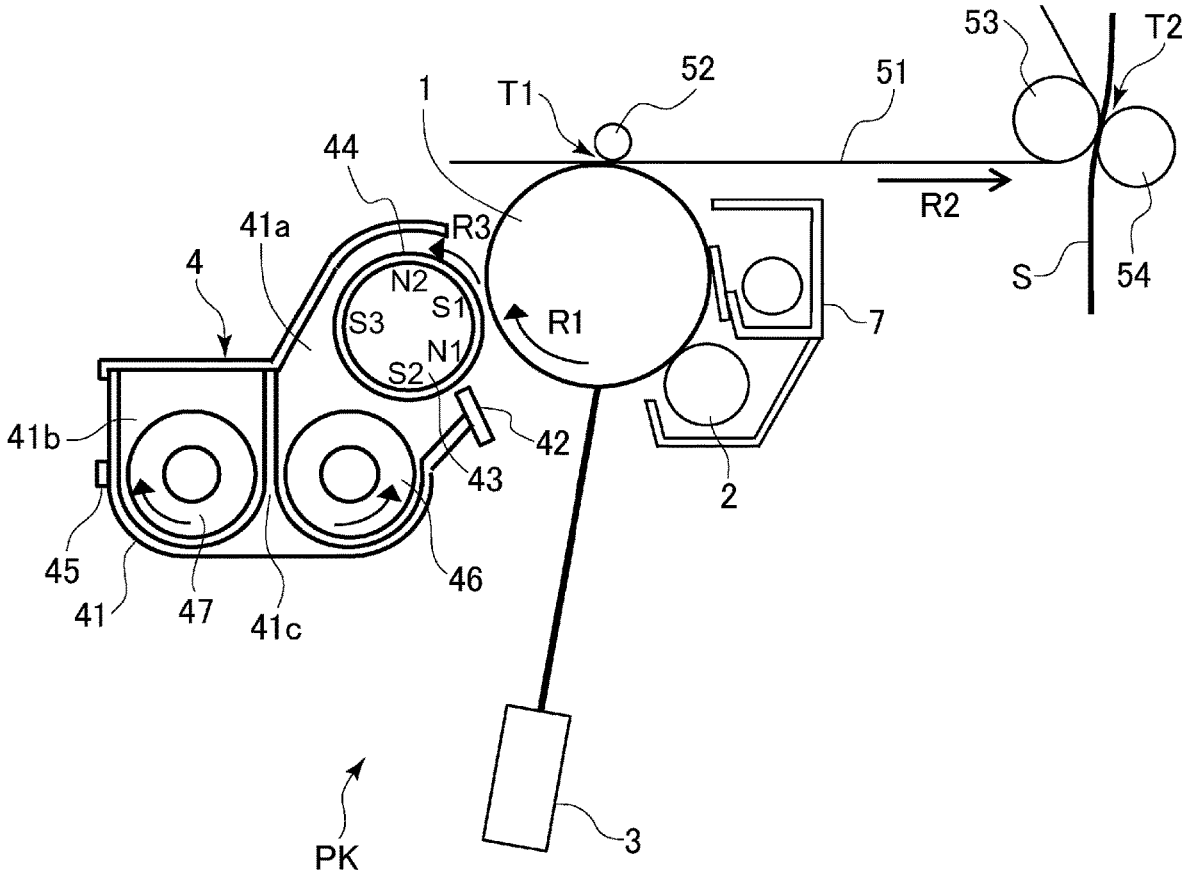
FIG. 2 is a schematic view showing a structure of an image forming portion and a periphery thereof.

In the image forming portion PK, as shown in FIG. 2, the photosensitive drum 1 is rotatably provided. The photosensitive drum 1 is rotationally driven in an arrow R1 direction in the figure. Around the photosensitive drum 1, a charging device 2, an exposure device (laser scanner) 3, a developing device 4, a primary transfer roller 52 and a cleaning device 7 are provided.

First, a surface of the photosensitive drum 1 rotated in synchronism with a start of an image forming operation is electrically charged uniformly by the charging device 2. Then, the photosensitive drum 1 is subjected to scanning exposure to laser light corresponding to an image signal sent from the exposure device 3. As a result, the electrostatic latent image depending on the image signal is formed on the photosensitive drum 1. The electrostatic latent image formed on the photosensitive drum 1 is developed into the toner image by a two-component developer (specifically toner) accommodated in the developing device 4. In the case of this embodiment, the developing device 4 is provided so as to be freely inserted into and extracted from the apparatus main assembly 100A. The developing device 4 as a developer accommodating device will be described later.

The toner image formed on the photosensitive drum 1 is primary-transferred onto the intermediary transfer belt 51 at a primary transfer portion T1 formed between the photosensitive drum 1 and the intermediary transfer belt 51 sandwiched between the photosensitive drum 1 and the primary transfer roller 52. At this time, to the primary transfer roller 52, a primary transfer bias is applied. Toner remaining on the photosensitive drum 1 after primary transfer is removed by the cleaning device 7.

The above-described operation is successively performed in the image forming portions PY to PK for yellow, magenta, cyan and black, so that four color toner images are superposed on the intermediary transfer belt 51. Thereafter, the recording material accommodated in the cassette 9 is fed to the secondary transfer portion T2 in synchronism with the toner image formation timing.

Then, by applying a secondary transfer bias to the secondary transfer outer roller 54, the four color toner images are secondary-transferred from the intermediary transfer belt 51 onto the recording material. Toner remaining on the intermediary transfer belt 51 without being not completely transferred onto the recording material at the secondary transfer portion T2 is removed by an intermediary transfer belt cleaner 55.

The recording material on which the toner images are secondary-transferred is fed to a fixing device 6. The fixing device 6 includes a fixing roller 61 and a pressing roller 62, and a fixing nip is formed by the fixing roller 61 and the pressing roller 62. Incidentally, the fixing roller 61 may also be a film or a belt, and the pressing roller 62 may also be a belt. By passing the recording material through the fixing nip, the recording material is heated and pressed. As a result, the toner on the recording material is melted and mixed and thus is fixed as a full-color image on the recording material. Thereafter, the recording material is discharged onto a discharge tray 11 by a discharging roller 10. Thus, a series of image forming process operations is ended.

Incidentally, the image forming apparatus 100 of this embodiment may also be capable of forming a single (color) image of a single color, for example, black or forming a multi-color image of arbitrary colors in combination.

Further, in the case of this embodiment, above the developing devices 4 of the image forming portions PY-PK, supplying devices 8 are provided, respectively. The supplying devices 8 supply agents (developers for supply) to the developing devices 4 of the respective image forming portions PY-PK depending on an average (average image ratio) of image ratios of an image to be formed or a detection signal or the like of a permeability sensor 45 (FIG. 2) or a density (concentration) detecting sensor (not shown). The permeability sensor 45 is used for detecting a toner content of the developer in the developing device 4, and the density detecting sensor is used for detecting a density of a patch image for density adjustment formed on the intermediary transfer belt 51.

[Developing Device]

An outline of the developing device 4 will be described using FIGS. 2 and 3. The developing device 4 includes a developer (developing) container 41 as an accommodating member capable of accommodating a two-component developer containing non-magnetic toner and a magnetic carrier. That is, in this embodiment, a two-component development type is used as a development type, and the developer in which the non-magnetic toner having a negative chargeability and the magnetic carrier having a positive chargeability are mixed with each other is used. As an example, the non-magnetic toner is prepared by incorporating a colorant, a wax component and the like is a resin binder (material) such as polyester or styrene-acrylic resin, followed by pulverization or polymerization into powder and then by adding fine powder of titanium oxide or silica to a surface of the powder. The magnetic carrier is obtained by kneading ferrite particles or magnetic powder with resin particles and then by subjecting a surface layer of a core of the kneaded product to resin coating.

The developer container 41 is, as shown in FIG. 2, open at a portion of a developing region opposing the photosensitive drum 1, and at this opening, a developing sleeve 44 as a developer carrying member is rotatably provided so as to be partly exposed. Inside the developing sleeve 44, a magnetic roller 43 having a plurality of magnetic poles along a circumferential direction is non-rotationally provided. The developing sleeve 44 is formed of a non-magnetic material and is rotated in an arrow R3 direction of FIG. 2 during a developing operation, and thus conveys the developer to the developing region while carrying the developer.

Figure 3:
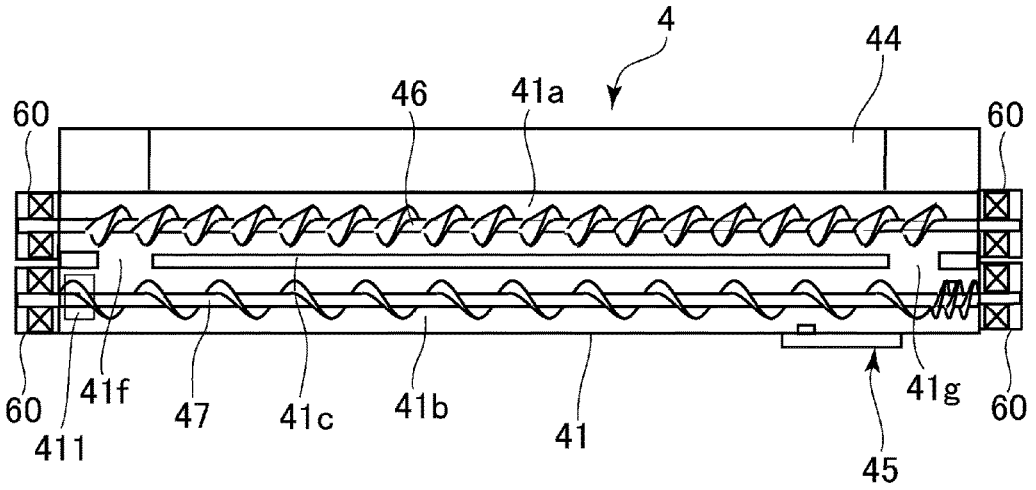
FIG. 3 is a top plan view showing a developing device as seen in a horizontal cross section including an axial direction.

As shown in FIG. 3, in the developer container 41, a developing chamber 41*a* as a first chamber capable of accommodating the developer and a stirring chamber 41*b* as a second chamber are formed, and the developing chamber 41*a* and the stirring chamber 41*b* form a circulating path along which the developer is circulated. An inside of the developer container 41 is partitioned into the developing chamber 41*a* and the stirring chamber 41*b* by a partition wall 41*c* so that the developing chamber 41*a* and the stirring chamber 41*b* communicate with each other through a first communicating opening 41*b* and a second communicating opening 41*f* which are delivery portions on both sides of the developer container 41 with respect to a rotational axis direction of the developer container 41.

In the developing chamber 41*a* and the stirring chamber 41*b*, a developing screw 46 as a first feeding screw and a stirring screw 47 as a second feeding screw are provided, respectively. Each of the developing screw 46 and the stirring screw 47 is a screw provided with a helical blade around a rotation shaft thereof and is capable of feeding the developer in the developer container (accommodating member) 41 while stirring the developer. The developer in the developing chamber 41*a* is moved in a first direction (left to right in FIG. 3) while being stirred by the developing screw 46 and is delivered from the developing chamber 41*a* to the stirring chamber 41*b* through the second communicating opening 41*f*. On the other hand, the developer in the stirring chamber 41*b* is moved in a second direction (right to left in FIG. 3) opposite to the first direction while being stirred by the stirring screw 47 and is delivered from the stirring chamber 41*b* to the developing chamber 41*a* through the first communicating opening 41*g*. Thus, the developer is fed and circulated in the developer container 41 while being stirred by the developing screw 46 and the stirring screw 47. Each of the developing screw 46 and the stirring screw 47 is rotatable supported by bearing portions 60 provided at both end portions with respect to a rotational axis direction of the screw.

A pair of the developer in the developer container 41 is capable of being supplied to the developing sleeve 44 during feeding by the developing screw 46. The developer supplied to the developing sleeve 44 forms a developer accumulation portion by being carried in a predetermined amount on the developing sleeve 44 by a magnetic field generated by the magnet roller 43. The developer supplied to the developing sleeve 44 is passed through the developer accumulation portion by rotation of the developing sleeve 44, so that a layer thickness is regulated by a regulating blade 42 and at the same time, the developer is fed into the developing region opposing the photosensitive drum 1. In the developing region, the developer on the developing sleeve 44 is erected and thus a magnetic chain of the developer is formed. Then, the magnetic chain is brought into contact with the photosensitive drum 1, so that the toner of the developer is supplied to the photosensitive drum 1, with the result that the electrostatic latent image formed on the photosensitive drum 1 is developed as the toner image. At that time, to the developing sleeve 44, a developing bias, for example, in the form of a DC voltage biased with an AC voltage is applied.

In the stirring chamber 41*b*, a supply opening 411 as a receiving port through which the developer supplied from the supplying device 8 is to be received is formed on an upstream side of the stirring screw 47 with respect to a developer feeding direction. In the case where development of the electrostatic latent image is carried out using the two-component developer, the toner is consumed with development of the electrostatic latent image into the toner image, so that the toner content of the developer in the developer container 41 lowers so as to be less than a target toner content (for example 8%). Therefore, in order to return the toner content of the developer in the developer container 41 to the target toner content, ATR (Automatic Toner Replenisher) control in which the toner is supplied depending on a detection signal of the permeability sensor 45 is carried out. In the ATR control, the toner as the supply agent (developer for supply) is supplied form the supplying device 8 through the supply opening (receiving port) 411. The supply agent supplied to the stirring chamber 41*b* through the supply opening 411 is fed and stirred, by the stirring screw 47, together with the developer delivered from the developing chamber 41*a* to the stirring chamber 41*b* through the second communicating opening 41*f*. Incidentally, in the case where "upstream" and "downstream" are mentioned unless otherwise specified in the following, "upstream" and "downstream" refer to those with respect to the developer feeding direction (second direction) of the stirring screw 47.

Figure 4:
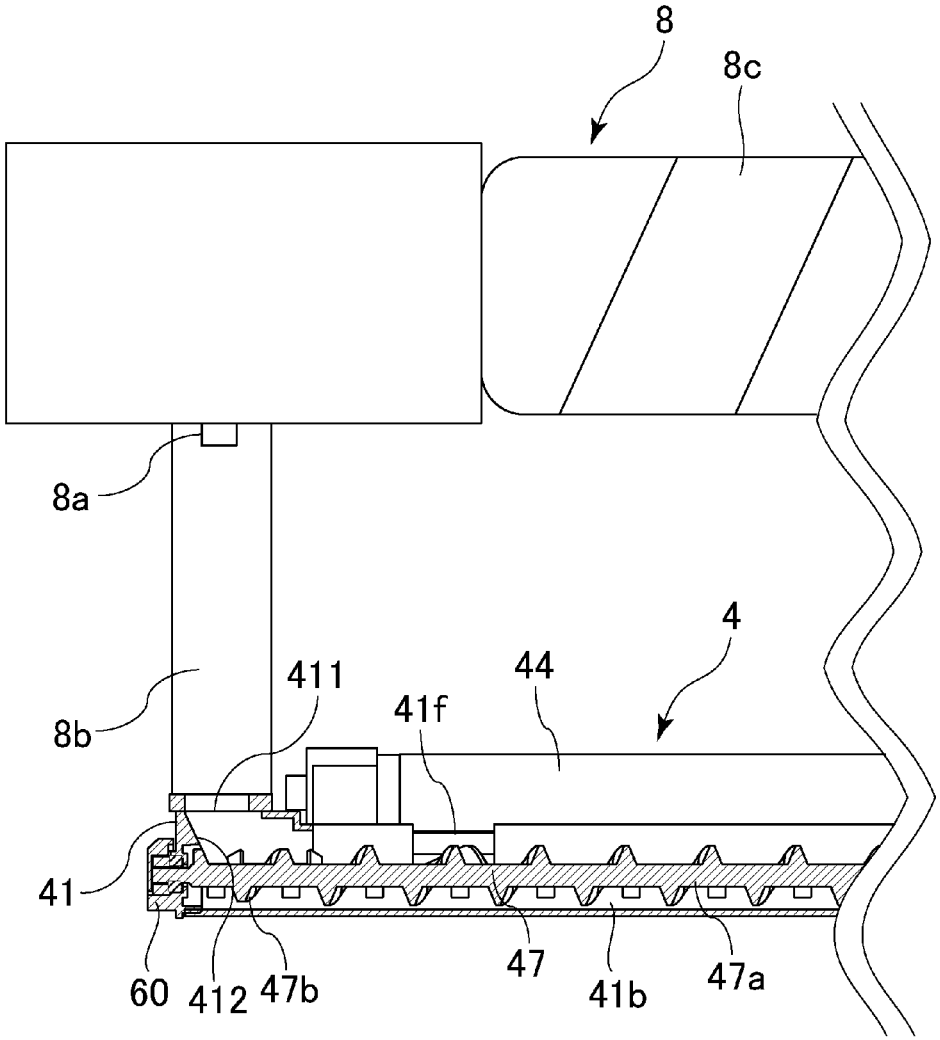
FIG. 4 is a partially sectional view showing a neighborhood of a bearing portion in the developing device of the embodiment.
Figure 5:
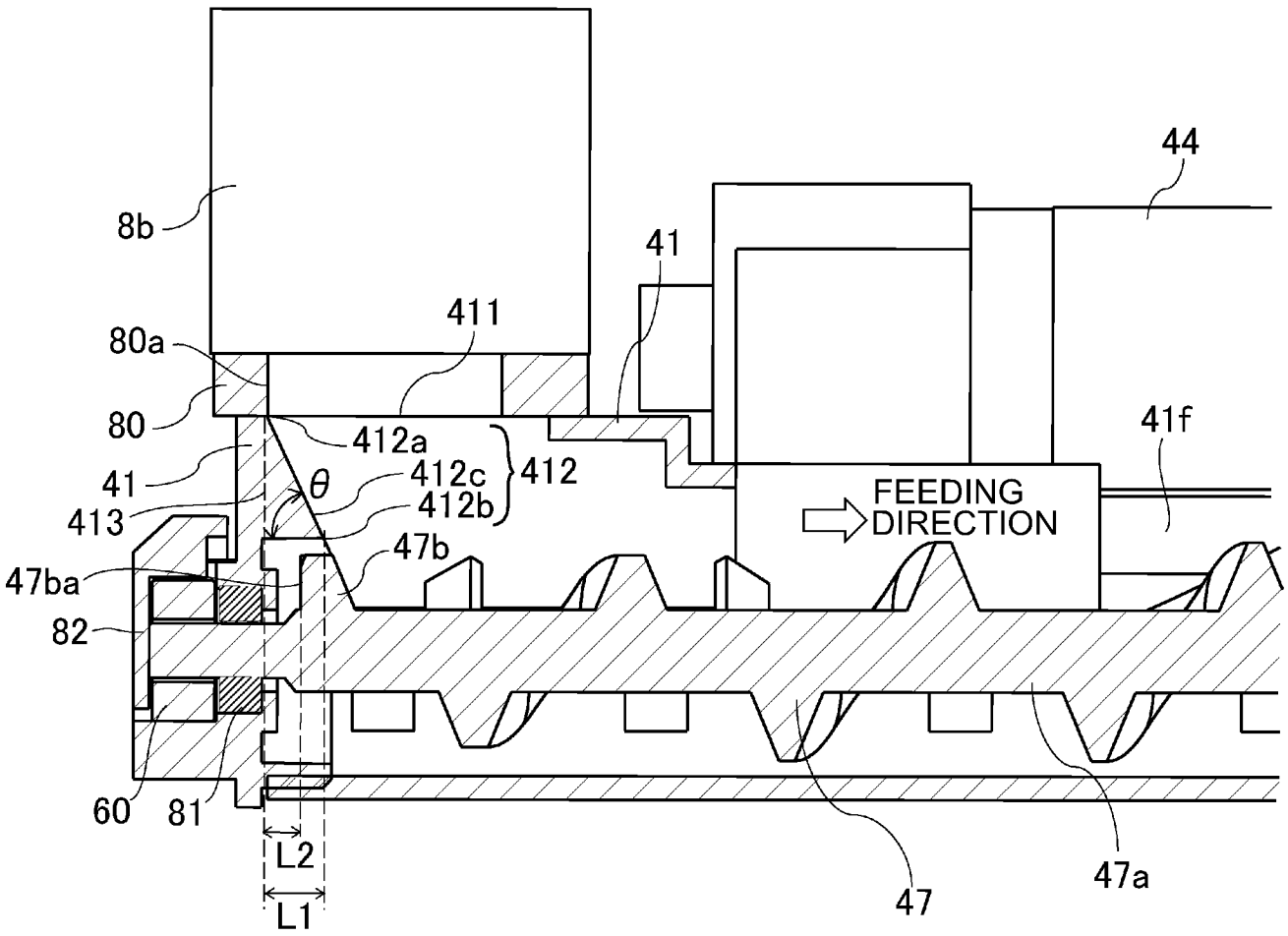
FIG. 5 is an enlarged sectional view of the neighborhood of the bearing portion shown in FIG. 4.

Next, details of the developing device 4 in this embodiment will be described using FIGS. 4 and 5. FIG. 4 shows a neighborhood of the bearing portion 60 for supporting the end portion of the stirring screw 47 on an upstream side in the developing device 4 of this embodiment. FIG. 5 shows the neighborhood of the bearing portion 60 shown in FIG. 4 in an enlarged manner.

As shown in FIG. 4, in this embodiment, in order to supply the supply agent, a supplying feeding path 8*b* extending from a supply agent discharging opening 8*a* of the supplying device 8 toward the developer container 41 is connected to the supply opening 411 of the developer container 41. In the case of this embodiment, the supply opening 411 is formed outside the circulating path of the developer, i.e., on a side upstream of the second communicating opening 41*f* so as to contact an inner wall surface 413 of the developer container 41 provided with the bearing portion 60 on a most upstream side of the stirring chamber 41*b*. The supply opening 411 is formed above the stirring screw 47 so as to partially overlap with the stirring screw 47 as seen from above. That is, the developer received through the supply opening 411 can fall on the stirring screw 47. The supply opening 411 is provided with a supply opening seal 80 disposed at a connecting portion with the feeding path 8*b* for supplying the supply agent, so that the toner is prevented by the supply opening seal 80 from leaking out of the connecting portion during supply of the supply agent.

Incidentally, the supply opening 411 is not limited to that formed at an upper wall portion of the developer container 41, but may also be at a side wall portion, where the bearing portion 60 is not provided, with respect to a widthwise direction crossing the developer feeding direction. Also in this case, the supply opening 411 is formed above the stirring screw 47 and may only be required to cause the developer supplied through the supply opening 411 to fall on the stirring screw 47.

A supply container 8*c* in which the supply agent is accommodated in advance is provided with a helical groove at an inner wall of a cylinder thereof, and by rotation of the supply container 8*c* itself, the supply agent is fed toward the supply agent discharge opening 8*a* side along the groove. The supply agent fed to the supply agent discharge opening 8*a* side is discharged through the supply agent discharge opening 8*a* by air pressure generated by a pump capable of changing a volume of the supply container 8*c*.

The stirring screw 47 includes a rotation shaft 47*a* rotatably supported, at an end portion thereof with respect to the rotational axis direction, by the bearing portion 60 provided in the developer container 41. The bearing portion 60 is, for example, a sliding (plain) bearing formed in a cylindrical shape by a resin material and is mounted in the developer container 41. Further, outside the developing sleeve 44, a retaining cover 82 is mounted so that the bearing portion 60 is not disconnected from the developer container 41 by movement thereof in the rotational axis direction of the stirring screw 47.

The bearing portion 60 may preferably be formed of a resin material, for example, a fluorine-containing polyacetal or a fluorine-containing polyamide, having a feature such that a resultant bearing portion is liable to be abraded (worn) compared with the stirring screw 47 (specifically the rotation shaft 47*a*) which is an object to be borne (supported) but is easily slid compared with the stirring screw 47. As an example, in the case where the stirring screw 47 is formed of the polyacetal, when the bearing portion 60 is formed of the polyimide, high durability and low abrasiveness may preferably be achieved. Incidentally, in the case where the developer container 41 is formed of the above-described resin material, when the bearing portion 60 is integrally molded with the developer container 41, the integrally molded member may preferably contribute a cost reduction.

As described above, when the developer enters the bearing portion 60, the toner contained in the developer is melted by heat generated by friction between the rotating stirring screw 47 and the rotating bearing portion 60 and then is agglomerated by being cooled, so that the toner can adhere to the bearing portion 60. When the developer (toner) adheres to the bearing portion 60, the stirring screw 47 is not readily rotated at a desired process speed, and the rotation shaft 47*a* is liable to be broken. Therefore, in this embodiment, in order to suppress that the developer enters the bearing portion 60, a bearing seal 81 formed in a ring shape is provided to the bearing portion 60.

Incidentally, the neighborhood of the bearing portion 60 below the supply opening 411 in the developer container 41 is outside the circulating path of the developer, and therefore, during feeding of the developer, there is substantially no developer. However, in such a case that the supply agent in a large amount is received at once through the supply opening 411, the supply agent temporarily increases in some instances. In such a case, the feeding of the supply agent by the stirring screw 47 cannot catch up with the temporarily increased supply agent, so that the supply agent can enter the bearing portion 60. Further, the bearing portion 60 and the bearing seal 81 can cause frictional heat by friction thereof with the rotating stirring screw 47. When the frictional heat generates, the heat is conducted to the neighborhood of the bearing portion 60, so that a temperature increases. In the case where a state in which the temperature reaches about a melting point (temperature) of the toner is formed, when the developer exist in the neighborhood of the bearing portion 60, the toner is melted and then is cooled, so that the toner agglomerates. When the toner agglomerates and adheres to the bearing portion 60, the stirring screw 47 cannot readily be rotated at a predetermined process speed. Or, the agglomerated toner is fed by the developing sleeve 44 and is sandwiched between the developing sleeve 44 and the regulating blade 42, so that the toner is deposited at that portion. As a result, there is a liability that stripe density non-uniformity occurs on the image.

In order to prevent the toner from melting, the developer may only be required to be prevented from moving toward the neighborhood of the bearing portion 60, to the extent possible, where the temperature can increase due to heat generated by the stirring screw 47 rotating in the developer container 41. As described above, the neighborhood of the bearing portion 60 below the supply opening 411 is positioned outside the developer circulating path, and therefore, the developer little exists during feeding thereof and has no problem. However, when the supply agent in the large amount is received at once through the supply opening 411 and is temporarily increased in amount, the supply agent is also moved to the neighborhood of the bearing portion 60 where the temperature can increase, so that toner melting can occur. In view of this point, in this embodiment, not only the supply agent received through the supply opening 411 is caused to not readily enter the bearing portion 60, but also a partitioning portion (guiding portion) 412 is provided in the developer container 41 in order to move the supply agent away from the neighborhood of the bearing portion 60 where the temperature can increase. In the following, the partitioning portion 412 will be described.

[Partitioning Portion]

As shown in FIG. 5, the partitioning portion 412 partitions an inside of the developer container 41 into a supply opening 411 side (receiving port side) and a bearing portion 60 side. For that purpose, the partitioning portion 412 is disposed between the supply opening 411 and the stirring screw 47 with respect to a vertical direction and below the supply opening 411 so that the partitioning portion 412 overlaps with a part of the supply opening 411 as seen from above. Specifically, the partitioning portion 412 includes an upstream end portion 412*a* at an upper surface thereof so as to be positioned on an upstream side including an upstream end 80*a* of the supply opening 411. Further, the partitioning portion 412 includes a downstream end portion 412*b* at a lower surface thereof so as to be positioned on a downstream side including a mostupstream end portion 47*ba* of the blade 47. That is, the partitioning portion 412 has a length L1 from the inner wall surface 413 of the developer container 41 to the downstream end portion 412*b* at the lower surface, and the length L1 is longer than a length L2 from the inner wall surface 413 to the mostupstream end portion 47*ba* of the blade 47. Incidentally, the partitioning portion 412 may preferably be disposed above the stirring screw 47 so as to minimize an interval from an upper end of the blade 47*b*.

In the case of this embodiment, the partitioning portion 412 is formed integrally with the inner wall surface 413 of the developer container 41 provided with the bearing portion 60 so that the upstream end portion 412*a* thereof coincides with the upstream end 80*a* of the supply opening 411. That is, the partitioning portion 412 is formed with no gap between itself and the inner wall surface 413 of the developer container 41. Further, the partitioning portion 412 may preferably be formed with no gap in the portion 41 between itself and side wall portions, where the bearing portion 60 is not provided, with respect to a widthwise direction crossing the developer feeding direction, i.e., formed transversely in the developer container 41 with respect to the widthwise direction.

Further, the partitioning portion 412 includes an inclined surface 412*c* inclined downwardly from the upstream side toward the downstream side thereof with respect to the developer feeding direction. The inclined surface 412*c* is inclined, with respect to the horizontal surface, with an angle (inclination angle θ) larger than an angle of repose of the supply agent to be received through the supply opening 411. As a result, the supply agent received through the supply opening 411 slides down the inclined surface 412*c* and thus can fall on the stirring screw 47 side.

Here, a measuring method of the angle of repose will be described using parts (a) and (b) of FIG. 6. The angle of repose α of the supply agent can be measured using a measuring device 200 of the angle of repose shown in parts (a) and (b) of FIG. 6. The measuring method is such that a supply agent T to be measured is filled in the measuring device 200 shown in part (a) of FIG. 6, and thereafter as shown in part (b) of FIG. 6, the measuring device 200 is gradually inclined relative to the horizontal surface so as to increase the inclination angle. Then, as shown in part (c) of FIG. 6, the inclination angle when the supply agent T filled in the measuring device 200 slides down is taken as the angle of repose α of the supply agent T as a measuring object. In the case of this embodiment, for example, in the case where the angle of repose α of the supply agent T is 45°-50°, the partitioning portion 412 is formed so that the inclination angle θ of the inclined surface 412*c* is about 65° larger than the angle of repose α.

As described above, in the case of this embodiment, the partitioning portion 412 including the inclined surface 412*c* is formed so as to overlap with a part of the supply opening 411 as seen from above and so that the downstream end portion 412*b* at the lower surface is positioned on the downstream side including the most upstream end portion 47*ba* of the blade 47*b*. The inside of the developer container 41 is partitioned into the supply opening 411 side and the bearing portion 60 side by the partitioning portion 412, so that the supply agent received through the supply opening 411 does not readily enter the bearing portion 60. Further, the supply agent received through the supply opening 411 is caused to fall along the inclined surface 412*c* on a position spaced from the bearing portion 60 with respect to the developer feeding direction, so that the supply agent does not readily enter the bearing portion 60. Further, the position spaced from the bearing portion 60 is on the downstream side including the most upstream end portion 47*ba* of the blade 47*b*, so that the supply agent is immediately fed by the stirring screw 47 in a direction in which the supply agent is moved away from the bearing portion 60. Thus, in this embodiment, by providing the partitioning portion 412, the supply agent received through the supply opening 411 can be made hard to enter the bearing portion 60, so that the supply agent can be moved away from the neighborhood of the bearing portion 60 where the temperature can increase. That is, an effect such that a decrease in degree of agglomeration of the toner, contained in the developer (the supply agent in this case), caused due to the rotating stirring screw 47 can be realized by a simple constitution without upsizing the developing device can be achieved.

Other Embodiments

In the above-described embodiments, the partitioning portion 412 includes the inclined surface 412*c*, and the supply agent received through the supply opening 411 is caused to slide down along the inclined surface 412*c*, but the present invention is not limited thereto. For example, as shown in FIG. 7, a partitioning portion 412A may also not include the inclined surface 412*c* (FIG. 5). In FIG. 7, constituent elements similar to those in the above-described embodiment are represented by the same reference numerals or symbols and will be briefly described or omitted from description in the following embodiment.

Similarly, as in the above-described embodiment, as regards the partitioning portion 412A, an upstream end portion 412*a* at an upper surface thereof is positioned on an upstream side including an upstream end 80*a* of the supply opening 411 with respect to the developer feeding direction of the stirring screw 47. Further, the partitioning portion 412A includes a downstream end portion 412*b* at a lower surface thereof positioned on a downstream side including a most upstream end portion 47*ba* of the blade 47*b*. The partitioning portion 412A is formed so as to establish such a positional relationship. As a result, the supply agent received through the supply opening 411 does not readily enter the bearing portion 60. Further, the supply agent can be moved away from the neighborhood of the bearing portion 60 where the temperature becomes high. Accordingly, it is possible to achieve an effect similar to the effect of the above-described embodiment such that the decrease in degree of agglomeration of the toner, contained in the developer (the supply agent in this case), caused due to the rotating stirring screw 47 can be realized by a simple constitution without upsizing the developing device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-079406 filed on Apr. 17, 2018, which is hereby incorporated by reference herein in its entirety.

What is claimed is:

1. A developing device comprising:

an accommodating member provided with a receiving port through which a developer is received and capable of accommodating the developer;

a developer carrying member supported by said accommodating member and configured to carry and feed the developer;

a feeding screw capable of feeding the developer supplied through said receiving port, wherein said feeding screw is provided below said receiving port in a vertical direction and is provided with a rotation shaft and a helical blade formed around said rotation shaft;

a bearing portion configured to support said feeding screw on a side upstream of said feeding screw with respect to a developer feeding direction; and a guiding portion including an inclined surface which is inclined downward in the vertical direction from an upstream side toward a downstream side thereof with respect to the developer feeding direction and which is configured to guide, toward said feeding screw, the developer received through said receiving port, wherein with respect to the developer feeding direction, a position of an edge of said receiving port on a bearing portion side is closer to said bearing portion than a most-upstream end of said blade with respect to the developer feeding direction, and wherein with respect to the developer feeding direction, a position of a downstream end portion of said inclined surface is remoter from said bearing portion than the most-upstream end of said blade with respect to the developer feeding direction.

2. A developing device according to claim 1, wherein said inclined surface is inclined with an angle, relative to a horizontal surface, larger than an angle of repose of the developer.

3. A developing device according to claim 1, wherein with respect to the developer feeding direction, the position of the edge and a position of an upstream end portion of said inclined surface are substantially the same.

4. A developing device according to claim 1, further comprising a second feeding screw configured to feed the developer in a direction opposite to the developer feeding direction and configured to supply the developer to said developer carrying member.

5. A developing device according to claim 1, wherein said receiving port has an edge on a side opposite from said bearing portion with respect to the developer feeding direction, the edge being positioned above said blade.

6. A developing device according to claim 1, wherein said guiding portion is formed integrally with an inner wall of said accommodating portion.

7. A developing device comprising:

an accommodating member provided with a receiving port through which a developer is received and capable of accommodating the developer;

a developer carrying member supported by said accommodating member and configured to carry and feed the developer;

a feeding screw capable of feeding the developer supplied through said receiving port, wherein said feeding screw is provided below said receiving port in a vertical direction and is provided with a rotation shaft and a helical blade formed around said rotation shaft;

a bearing portion configured to support said feeding screw on a side upstream of said feeding screw with respect to a developer feeding direction, and wherein with respect to the developer feeding direction, a position of an edge of said receiving port on a bearing portion side is closer to said bearing portion than a most-upstream end of said blade with respect to the developer feeding direction; and a guiding portion including an inclined surface which is inclined downward in the vertical direction from an upstream side toward a downstream side thereof with respect to the developer feeding direction and which is configured to guide, toward said blade of said feeding screw, the developer received through said receiving port.

8. A developing device according to claim 7, wherein said inclined surface is inclined with an angle, relative to a horizontal surface, larger than an angle of repose of the developer.

9. A developing device according to claim 7, wherein with respect to the developer feeding direction, the position of the edge and a position of an upstream end portion of said inclined surface are substantially the same.

10. A developing device according to claim 7, further comprising a second feeding screw configured to feed the developer in a direction opposite to the developer feeding direction and configured to supply the developer to said developer carrying member.

11. A developing device according to claim 7, wherein said receiving port has an edge on a side opposite from said bearing portion with respect to the developer feeding direction, the edge being positioned above said blade.

12. A developing device according to claim 7, wherein said guiding portion is formed integrally with an inner wall of said accommodating portion.

13. A developing device comprising:

a developing container including a first chamber configured to accommodate a developer containing toner and a carrier and a second chamber partitioned from said first chamber by a partition wall, the developer being circulated between said first chamber and said second chamber;

a first feeding screw arranged in said first chamber and configured to feed the developer in a first direction;

a second feeding screw arranged in said second chamber and configured to feed the developer in a second direction opposite to the first direction;

a receiving port provided in said second chamber and through which the developer supplied to said developing container is received;

a bearing portion arranged in an upstream side of said receiving port in the second direction and configured to rotatably support a rotational axis of said second feeding screw; and a guiding portion provided in said second chamber and configured to guide the developer received through said receiving port to said second feeding screw;

wherein an upstream end of said receiving port in the second direction is arranged upstream of an upstream end of a most-upstream blade portion which is located most-upstream in the second direction among blades of said second feeding screw, and wherein a downstream end of said guiding portion in the second direction is arranged downstream of the upstream end of the most-upstream blade portion in the second direction.

14. A developing device according to claim 13, wherein the downstream end of said guiding portion in the second direction is located below an upstream end of said guiding portion in a vertical direction, and said guiding portion is provided with an inclined surface which is inclined from the upstream end of said guiding portion toward the downstream end of said guiding portion in the second direction.

15. A developing device according to claim 14, wherein said inclined surface is inclined with an angle larger than an angle of repose of the developer.

16. A developing device according to claim 13, wherein with respect to the second direction, a position of the upstream end of said guiding portion coincides with a position of the upstream end of said receiving portion.

17. A developing device according to claim 13, further comprising a developer carrying member configured to bear the developer to develop an electrostatic latent image formed on an image bearing member, wherein the developer is supplied to said developer carrying member in said first chamber.

* * * * *